US008578963B2

(12) United States Patent
Richter

(10) Patent No.: US 8,578,963 B2
(45) Date of Patent: Nov. 12, 2013

(54) NONRETURN VALVE FOR AN EXHAUST LINE

(75) Inventor: Hans-Jürgen Richter, Marsberg (DE)

(73) Assignee: Centrotherm Systemtechnik Gmbh, Brilon (DE)

( * ) Notice: Subject to any disclaimer, the term of this patent is extended or adjusted under 35 U.S.C. 154(b) by 134 days.

(21) Appl. No.: 13/307,977

(22) Filed: Nov. 30, 2011

(65) Prior Publication Data

US 2012/0138168 A1 Jun. 7, 2012

(30) Foreign Application Priority Data

Dec. 3, 2010 (EP) ..... 10193660

(51) Int. Cl.
*F16K 15/00* (2006.01)

(52) U.S. Cl.
USPC ..... 137/512.2; 137/248; 137/251.1

(58) Field of Classification Search
USPC ..... 137/246, 248, 251.1, 252, 254, 512.2, 137/546
See application file for complete search history.

(56) References Cited

U.S. PATENT DOCUMENTS 2,413,804 A * 1/1947 Ulm ..... 137/248
2,527,892 A * 10/1950 Quist ..... 137/248
3,513,870 A * 5/1970 Hirao ..... 137/251.1
5,176,171 A * 1/1993 Andersson ..... 137/512.1
6,056,005 A * 5/2000 Piotrowski et al. ..... 137/248
6,629,621 B1 * 10/2003 Piotrowski et al. ..... 220/314

FOREIGN PATENT DOCUMENTS

| | | |
|---|---|---|
| DE | 443238 | 4/1927 |
| DE | 2346515 | 2/1975 |
| DE | 19906736 | 12/2000 |
| DE | 10037967 | 12/2001 |

OTHER PUBLICATIONS

European Search Report of European Application No. 10193660.07 dated Aug. 19, 2011.

* cited by examiner

*Primary Examiner* — John Rivell
*Assistant Examiner* — Reinaldo Sanchez-Medina
(74) *Attorney, Agent, or Firm* — Rankin, Hill & Clark LLP

(57) ABSTRACT

In a nonreturn valve having a tubular body, which can be installed in a vertical section of an exhaust line, a valve seat, formed within the tubular body, for at least one float, and at least one circumferential groove, which is open in the downstream direction, the intention is to make available a solution by means of which it is possible to provide a nonreturn valve that is simple, advantageous in terms of production engineering and has a particularly high performance, and to do so in a way which is simple in terms of design and is economical. This is achieved by virtue of the fact that the circumferential rim of the at least one float projects radially over the radially inner circumferential wall section and has an axial lip facing upstream, which extends into the circumferential groove in the axial direction when the at least one float is resting on the valve seat.

13 Claims, 5 Drawing Sheets

NONRETURN VALVE FOR AN EXHAUST LINE

Figure 1:
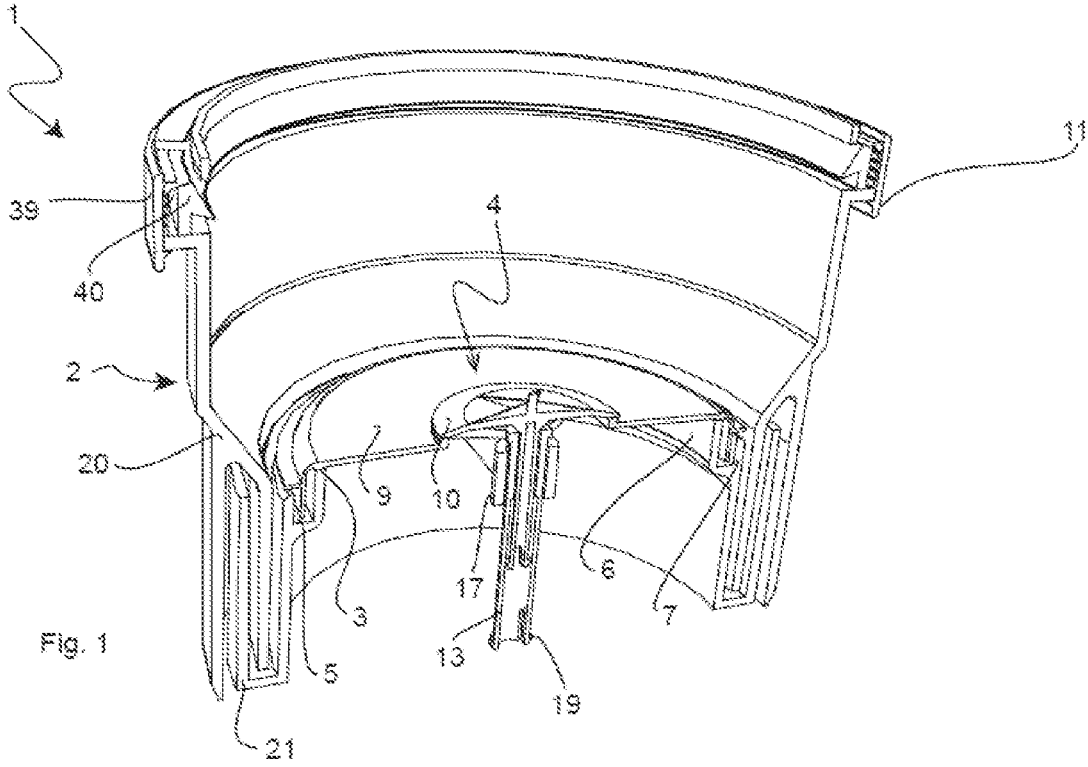

The invention relates to a nonreturn valve for an exhaust line of a combustion device, wherein the nonreturn valve comprises a tubular body, which can be installed in a vertical section of the exhaust line, a valve seat, formed within the tubular body, for at least one float, which can be raised from the valve seat by gas flowing vertically upward, and at least one circumferential groove, which is open in the downstream direction, is arranged radially on the inside in the tubular body and is delimited by a radially inner circumferential wall section and a radially outer circumferential wall section, wherein the radially inner circumferential wall section and the radially outer circumferential wall section are formed within the tubular body, and the circumferential rim of the radially inner circumferential wall section forms the valve seat for the at least one float.

Nonreturn valves of a known type are fitted with simple valve bodies or flaps which open wider or close depending on the gas pressure, for example. The return motion in known systems is accomplished either by means of the weight of the flaps or with the aid of return elements, such as springs.

A nonreturn valve of the type stated at the outset is described in DE 199 06 736 C1, for example. In this document, a float having a guide element oriented in the upstream direction in the form of a peg-type projection that is guided on the inner surface of guide webs is situated in a tubular body, and the guide webs are arranged in a manner oriented substantially radially inward on the inside of the tubular body.

A nonreturn valve of the type stated at the outset is furthermore known from DE 100 37 967 C1. In this nonreturn valve, the float, which can be raised from the valve seat by exhaust gas flowing upward, has at least two subsections, wherein each next-larger subsection forms an additional valve seat for the next-smaller subsection.

Although these designs of nonreturn valve have proven their worth, it has been found that they are amenable to improvement in their design, production and technical performance. For example, nonreturn valves of the type stated at the outset are produced as plastic injection moldings. However, the production of plastic injection moldings of large dimensions that are supposed to have an extremely small amount of distortion is difficult. Distortion of the components, e.g. of the float, has a direct effect on the amount of leakage and the leaktightness of the entire nonreturn valve. Moreover, the components of the nonreturn valve are exposed to massive temperature loads during the operation of the components of the nonreturn valve owing to the exhaust gas flowing through, and these temperature loads can additionally cause a distortion of the components.

It is therefore the underlying object of the invention to provide a solution which makes available a nonreturn valve of the type stated at the outset that is simple, advantageous in terms of production engineering and has a particularly high performance, and to do so in a way which is simple in terms of design and is economical, a solution which furthermore solves the problems known from the prior art with respect to nonreturn valve components produced by injection molding.

In the case of a nonreturn valve of the type indicated at the outset, this object is achieved, according to the invention, by virtue of the fact that the circumferential rim of the at least one float projects radially over the radially inner circumferential wall section and has an axial lip facing upstream, which extends upstream in the axial direction into the circumferential groove when the at least one float is resting on the valve seat.

Advantageous and expedient refinements and developments of the invention will emerge from the subclaims.

The invention provides a way of making available an improved nonreturn valve for an exhaust line of a combustion device in a manner which is simple in terms of design. As a result, the invention creates the conditions that allow nonreturn valves of large diameters and hence also combustion equipment that generates relatively large quantities of exhaust gas, e.g. high-power condensing boiler equipment, to be connected to a nonreturn valve according to the invention. In this arrangement, the radially inner circumferential wall section and the radially outer circumferential wall section which delimit the circumferential groove arranged radially on the inside in the tubular body can be part of the inner wall of the tubular body or can be formed integrally on the inner wall of the tubular body. When the combustion device is at a standstill, the float rests on the valve seat. Liquid which is formed downstream of the float can be directed into the circumferential groove by the axial lip of the float so that, when sufficient liquid has accumulated, the axial lip dips into the liquid. By dipping into the accumulated liquid, the axial lip of the float, together with the liquid, forms a liquid barrier in the manner of a fluid sealing seat, with the result that the float is closed in a gas tight manner. In this way, inaccuracies in the float production process due to component distortion can be compensated because the liquid fluid or liquid adapts to the outer contour and especially that of the axial lip formed on the circumferential rim of the float.

In order to secure the last-mentioned advantageous characteristic, irrespective of the quantity of liquid accumulated, a refinement of the invention envisages that a fluid situated in the circumferential groove enables the axial lip together with the fluid to form a gas tight fluid barrier when the float is resting on the valve seat. For this purpose, the circumferential groove is filled with a fluid or a liquid before the nonreturn valve is put into service, and the axial lip of the float, which faces upstream, therefore dips into the fluid in the circumferential groove when the float is resting on the valve seat.

In order furthermore to promote the drainage of excess condensate or fluid out of the circumferential groove toward the outside, it is advantageous if at least a section or sections of the circumferential rim of the radially outer circumferential wall section has/have a bevel extending radially outward and upstream.

In order additionally to prevent solid particles in the exhaust gas or heavy sediments from settling in the circumferential groove and possibly displacing the fluid required for the gas tight fluid barrier from the circumferential groove, a further refinement of the invention envisages that the float comprises a radial lip, which faces radially outward and extends at least into the region of the bevel on the circumferential rim of the radially outer circumferential wall section. Sediments or solid particles which flow or fall downward out of the exhaust gas, upstream in the direction of the float, cannot get into the circumferential groove because the radial lip covers and thus shields the circumferential groove. This ensures that only fluid is present in the circumferential groove so as to form a fluid sealing seat.

For cleaning the nonreturn valve, which is difficult to access from outside, a development of the invention envisages that the tubular body has at least one through opening, which is arranged and formed downstream of the circumferential rim of the radially outer circumferential wall section. This enables a water hose or just water to be introduced, for example, in order to clean the interior above the float during maintenance work. During operation, the through opening is closed by means of an appropriate closure means to ensure that no exhaust gases can escape.

A nonreturn valve of this kind is usually produced by means of a plastic injection molding process, although this process comes up against its limits in the case of complex shapes. To enable an economical and efficient production process of this kind to be used with the nonreturn valve according to the invention nevertheless, a development of the invention envisages that a tubular element and a support element that can be inserted into the tubular element and can be mounted removably on the tubular element form the tubular body. The tubular body is thus of at least two-part design. This makes it possible to produce the tubular element and the support element that can be mounted thereon at low cost in separate production steps.

To enable the support element to be mounted removably on the tubular element, it is advantageous if the tubular element and the support element are each designed as a double-walled tube section, wherein each tube section has an outer tube section and an inner tube section arranged coaxially with the outer tube section, and wherein each of the tube sections is furthermore closed at the end by a wall section connecting the outer tube section and the inner tube section. According to the invention, the diameters of the outer and the inner tube section of the tubular element are made larger than the diameters of the outer and inner tube sections of the support element, thus allowing the inner tube section of the tubular element to be introduced between the outer tube section and the inner tube section of the support element. The fitting together of the double-walled tube sections creates a system of channels which can be used to advantage.

As regards supplying the circumferential groove with accumulated fluid in the tubular body, it is furthermore advantageous if at least the outer tube section of the support element has a greater axial length than the inner tube section of the support element. This implies that the circumferential rim of the inner tube section is situated below the circumferential rim of the outer tube section in the upstream direction, thus enabling fluid which has accumulated between the outer tube section and the inner tube section of the support element to flow into the circumferential groove via the circumferential rim of the inner tube section.

As a development of the invention, provision is then made for the radially outer circumferential wall section to be formed by an axial section of the inner tube section, and for the radially inner circumferential wall section to be formed by a wall section which is formed integrally on the inner tube section of the support element and is oriented radially inward. This enables part of the inner tube section to serve simultaneously as a circumferential wall section of the circumferential groove, thus providing a low-cost solution that is simple in terms of design.

To make advantageous use of the two-part embodiment of the tubular body, a further refinement of the invention envisages that the insert element of double-walled design is open in the downstream direction and the tubular element of double-walled design is open in the upstream direction in the assembled condition of the nonreturn valve, wherein the inner tube section of the tubular element and the double-walled support element together form a U-shaped siphon in the assembled condition since the inner tube section of the tubular element is arranged between the outer tube section and the inner tube section of the support element. The support element accordingly forms a further circumferential groove which adjoins, radially toward the outside, the circumferential groove into which the axial lip of the float projects when resting on the valve seat. Since the inner tube section of the tubular element is preferably arranged coaxially between the inner and the outer tube section of the support element, a gas tight closure is also achieved in this region of the nonreturn valve if there is sufficient fluid or accumulated condensate within the double-walled tube section of the support element.

In a further refinement of the invention, provision is then made, in the case of the support element, for the circumferential rim of the inner tube section to end upstream of the circumferential rim of the outer tube section. This measure too serves to enable accumulated fluid to flow into the circumferential groove via the circumferential rim of the inner tube section.

In order to remove excess accumulated fluid from the tubular body, an advantageous development of the invention envisages that a drainage channel for fluid is formed between the outer tube section of the support element and the outer tube section of the tubular element.

In an alternative embodiment of a tubular body of one-part design, the invention envisages that the tubular body has at least one passage opening arranged upstream of the circumferential groove, wherein the at least one through opening is connected to a siphon, which is arranged outside the tubular body, which can be mounted removably thereon and into which fluid can drain from the interior of the tubular body, and wherein the siphon is connected to the at least one passage opening, through which fluid can be discharged from the siphon. As a result, the U-shaped siphon formed within the nonreturn valve is superfluous and is replaced by the external siphon. During maintenance work, this external siphon can be removed easily from the tubular body and can be cleaned without the need to remove the nonreturn valve and hence part of the exhaust system. In addition, water for cleaning the interior of the nonreturn valve and for flushing the siphon can be introduced through the passage opening and/or the through opening. Like the U-shaped siphon, the siphon arranged outside the tubular body prevents exhaust gas from flowing back into regions below the float.

In a further refinement of the invention, provision is made for the float to have a subsection of annular design and at least one subsection of disk-shaped design, wherein each next-larger subsection forms an additional valve seat for the next-smaller subsection. Compared with known single-stage nonreturn valves, it is possible, especially in the case of combustion systems with large exhaust gas flows, to match the aperture cross section to small exhaust gas flows of the kind which occur in part-load operation, for example, and, in full-load operation, to provide additional passage openings for the very large quantities of exhaust gas which arise.

In order to transfer the concept according to the invention of a fluid sealing seat to the inner subsections as well, a further refinement of the invention envisages that the circumferential rim of at least a next-smaller subsection comprises an additional axial lip, which projects radially outward over the additional valve seat, which is oriented in the upstream direction and which extends into an additional circumferential groove formed on the next-larger subsection when the next-smaller subsection is resting on the additional valve seat of the next-larger subsection.

According to another advantageous feature of the invention, provision is made for each next-smaller subsection and the next-larger subsection to engage telescopically one inside the other and to have interacting stops for limiting the lifting movement of the next-smaller subsection, wherein each next-smaller subsection of the float has a central projection, which is oriented in the upstream direction and engages in a central sleeve of the next-larger subsection, and wherein the sleeve forms the projection on the next-larger subsection, said projection being oriented in the upstream direction. Owing to the sleeve construction, two functions can be integrated into a single projection on a subsection. In this case, the outer side serves for self-guidance, whereas the inner side serves to guide the next-smaller subsection. This greatly simplifies the construction of the guides.

Finally, a refinement of the invention makes provision for the sleeve of the largest subsection of the float to be guided in a guide which is formed or supported by radially inward-projecting webs of the tubular body. Here too, it is advantageous to limit the maximum lifting movement of the largest subsection, by means of a stop in the form of a radial thickened portion on the upstream end of the sleeve, for example.

It goes without saying that the features mentioned above and those which remain to be explained below can be used not only in the respectively indicated combination but also in other combinations or in isolation without exceeding the scope of the present invention. The scope of the invention is defined exclusively by the claims.

Figure 2:
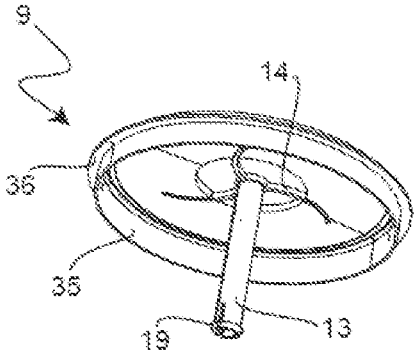
Figure 3:
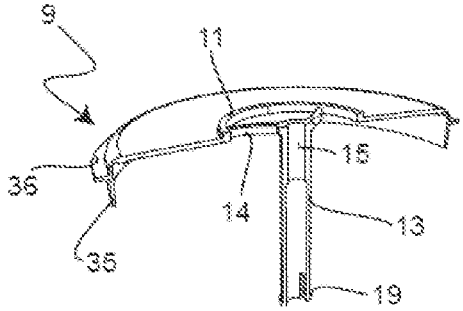
Figure 4:
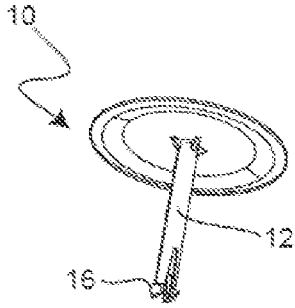
Figure 5:
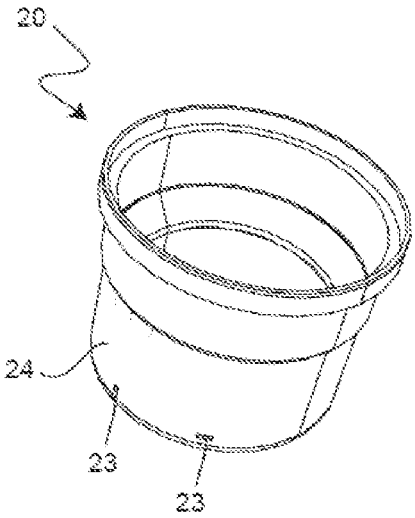
Figure 5:
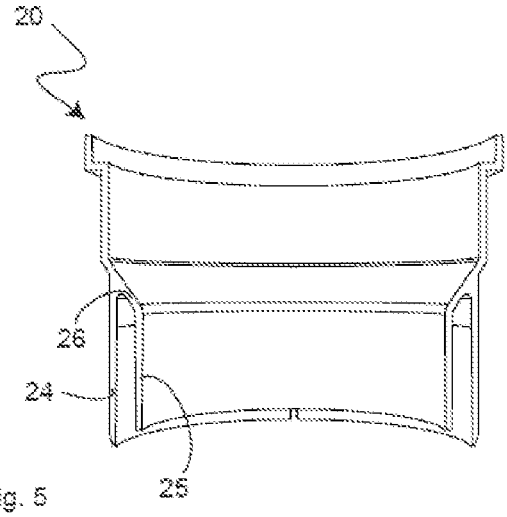
Figure 6:
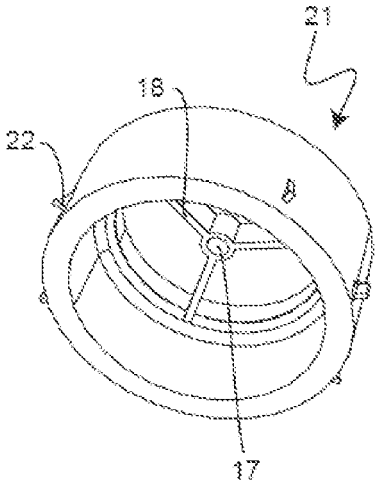
Figure 6:
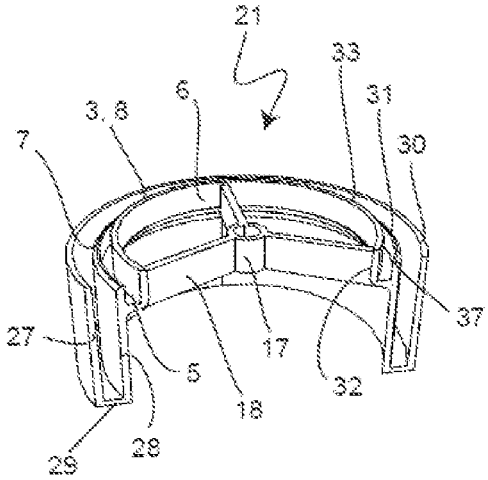
Figure 7:
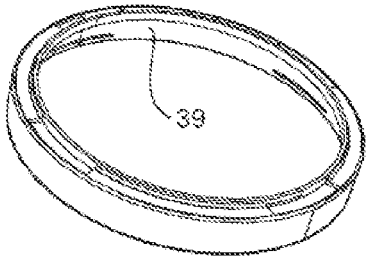
Figure 8:
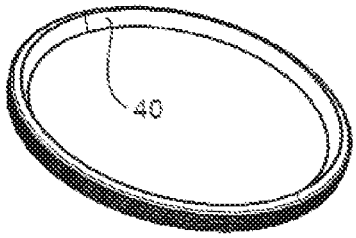
Figure 9:
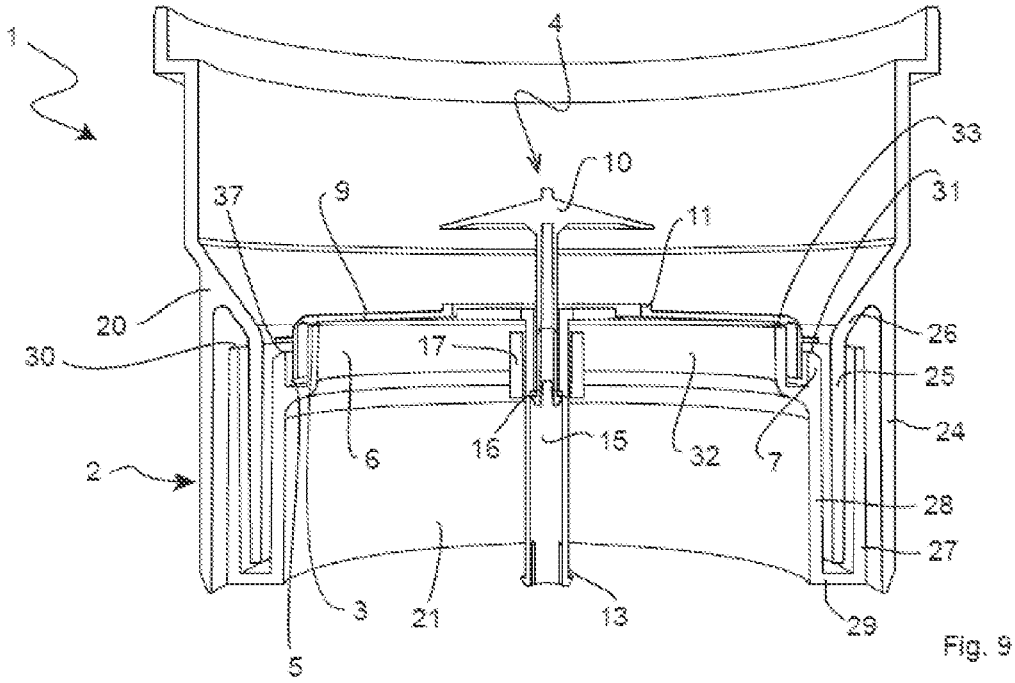
Figure 10:
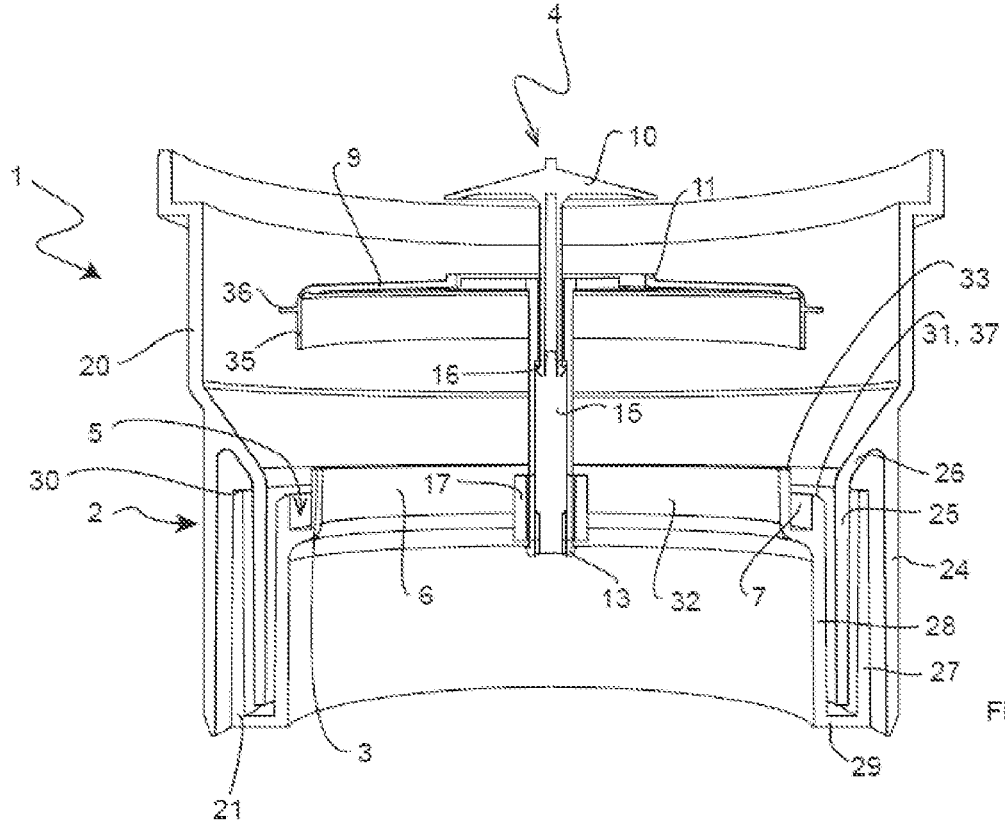
Figure 11:
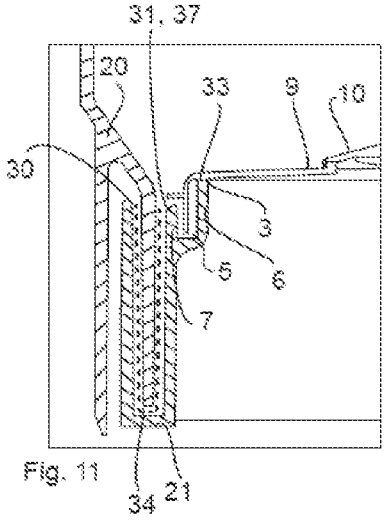
Figure 12:
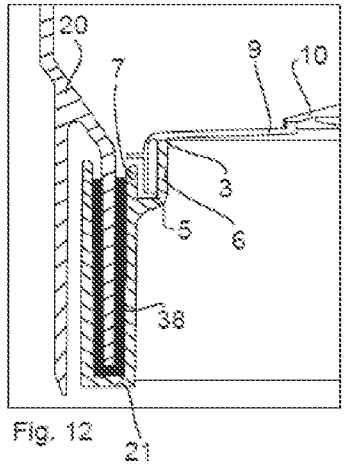
Figure 13:
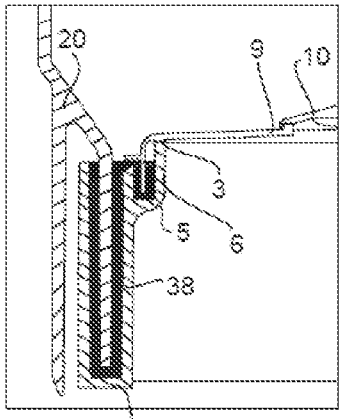
Figure 14:
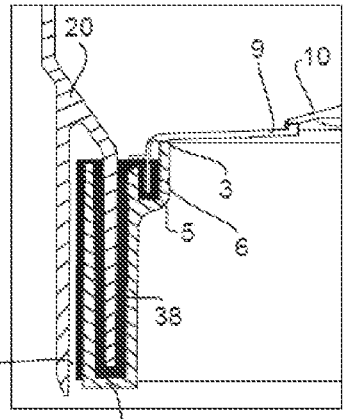
Figure 15:
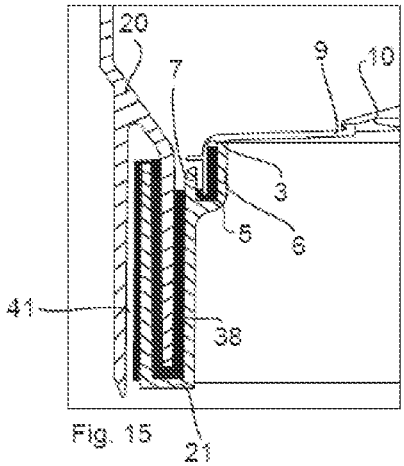
Figure 16:
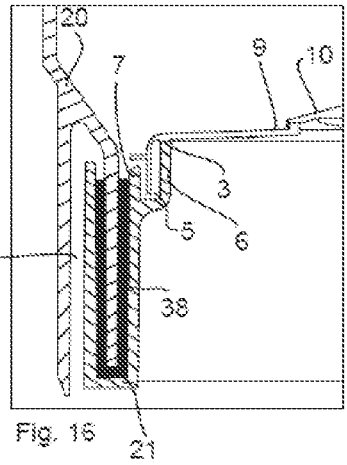
Figure 17:
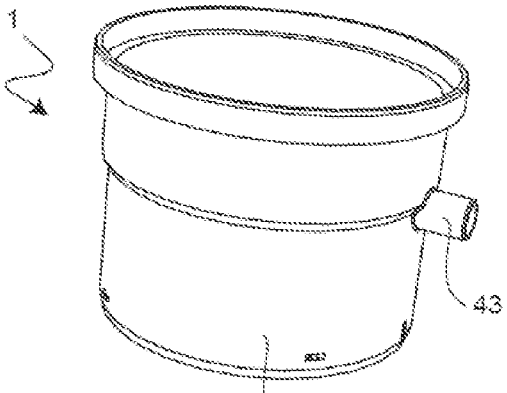
Figure 18:
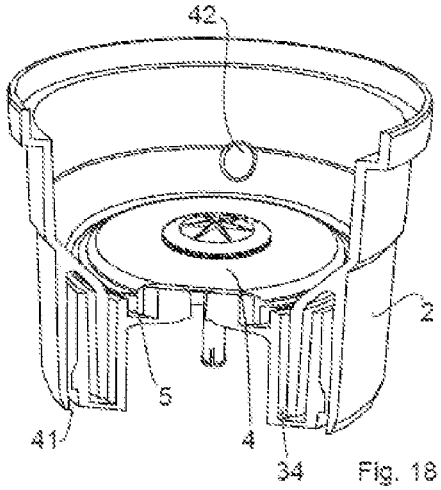
Figure 19:
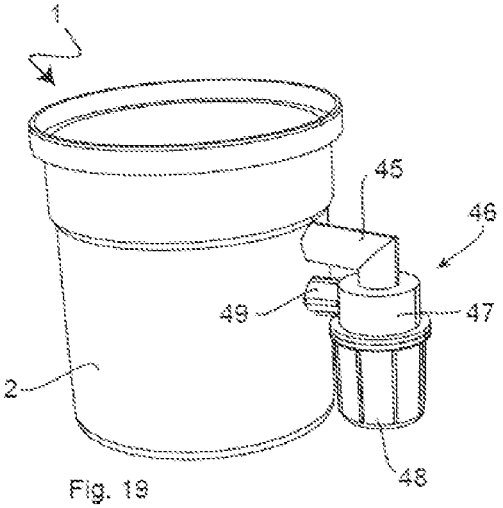
Figure 21:
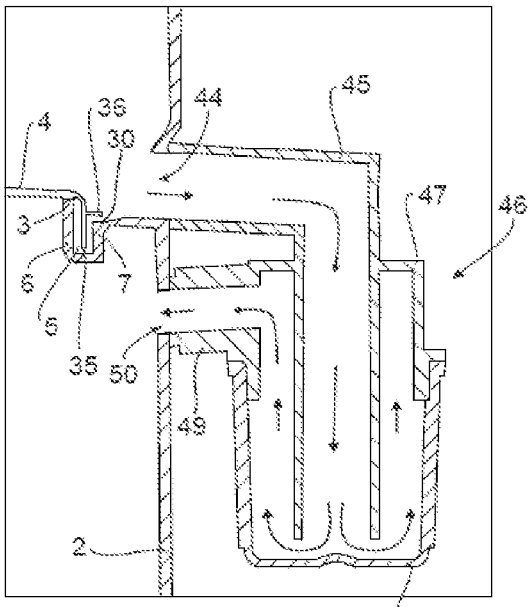
Figure 20:
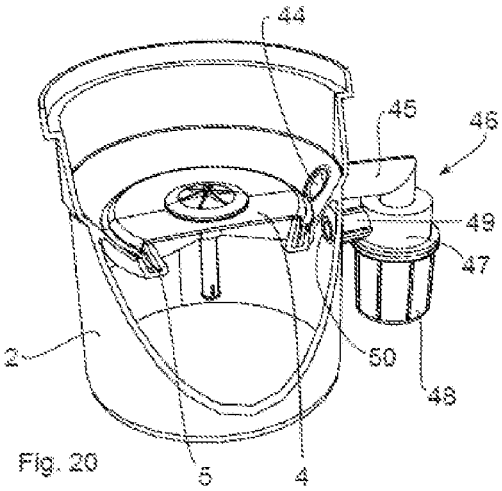

Further details, features and advantages of the subject matter of the invention will emerge from the following description in conjunction with the drawing, in which a preferred embodiment of the invention is illustrated by way of example. In the drawing:

FIG. 1 shows a partially sectioned perspective view of a nonreturn valve according to the invention, FIG. 2 shows an outer subsection of annular design of a float in perspective representation, FIG. 3 shows a sectional view of the outer subsection of annular design of the float shown in FIG. 2*a*, FIG. 4 shows an inner subsection of disk-shaped design of the float in perspective view, FIG. 5 shows a tubular element in perspective view and in a partial sectional view, FIG. 6 shows a support element in perspective view and in a partial sectional view, FIG. 7 shows a collar-shaped connecting element, FIG. 8 shows a seal element that can be inserted into the collar-shaped connecting element, FIG. 9 shows the position of the float in part-load operation, FIG. 10 shows the position of the float in full-load operation, FIG. 11 shows an operating state of the nonreturn valve immediately after installation in an exhaust line, FIG. 12 shows an operating state in which a U-shaped siphon is filled with a fluid, FIG. 13 shows an operating state in which the U-shaped siphon drains into a circumferential groove, FIG. 14 shows an operating state in which the U-shaped siphon drains into a drainage channel, FIG. 15 shows an operating state with an excess pressure prevailing downstream, FIG. 16 shows an operating state in which there is no fluid contained in the circumferential groove, FIG. 17 shows a development of the nonreturn valve according to the invention, FIG. 18 shows the development illustrated in FIG. 17 in a partially sectioned view, FIG. 19 shows a nonreturn valve in accordance with an alternative embodiment, FIG. 20 shows the nonreturn valve illustrated in FIG. 19 in a partially sectioned view, and FIG. 21 shows an enlarged sectional view of a detail of the nonreturn valve illustrated in FIGS. 19 and 20.

The nonreturn valve 1 according to the invention for an exhaust line of a combustion device is described below with reference to FIGS. 1 to 16. The nonreturn valve 1 illustrated in FIG. 1 in a partially sectioned perspective view has a tubular body 2, which can be installed in a vertical section of the exhaust line, through which the flow is from the bottom upward. Formed within the tubular body 2 is a valve seat 3, on which a float 4 rests in the closed position thereof. The float 4 can be raised from the valve seat 3 in the downstream direction by exhaust gas flowing vertically or from the bottom upward. At least one circumferential groove 5 open in the downstream direction is furthermore arranged within the tubular body 2. The circumferential groove 5 is delimited by a radially inner circumferential wall section 6 and a radially outer circumferential wall section 7, wherein the two circumferential wall sections 6 and 7 are formed within the tubular body 2. In this case, the circumferential rim 8 of the radially inner circumferential wall section 6 forms the valve seat 3 for the float 4, as can be seen from FIG. 6.

The float 4 comprises an outer subsection 9, which is shown in greater detail in FIGS. 2 and 3 and is of annular design, and an inner subsection 10, which is illustrated in FIG. 4 and is of disk-shaped design. In the closed position of the float 4 as shown in FIG. 1, the outer subsection 9 of the float 4 rests on the valve seat 3, which is provided within the tubular body 2. Moreover, the outer subsection 9 forms an additional valve seat 11 (see FIG. 3), on which the inner subsection 10 rests in the closed position. If the associated combustion device is operated in part-load mode, the inner or next-smaller subsection 10 rises from the additional valve seat 11 thereof and exposes the exhaust line partially or in part, as illustrated for part-load operation in FIG. 9 by way of example. In this case, the position of the inner subsection 10 adjusts to the quantity of exhaust gas to be discharged. If the quantity of exhaust gas rises further, as is the case with full-load operation of the combustion device, the outer subsection 9 of the float 4 also leaves the valve seat 3 thereof and exposes the maximum passage cross section of the nonreturn valve 1, as shown by way of example in FIG. 10. From FIGS. 2 to 4, it can furthermore be seen that the inner subsection 10 of the float 3 carries a projection 12, which is oriented in the upstream direction, i.e. downward, and engages telescope-fashion in a projection 13 on the outer subsection 9, said projection likewise being oriented in the upstream direction. The projection 13 on the outer subsection 9 is connected to the outer annular subsection 9 by radial webs 14 (see FIGS. 2 and 3). At its upper end, the projection 13 of sleeve-shaped design on the outer subsection 9 forms a guide 15 for the peg-shaped projection 12 on the inner subsection 10. On its lower end, the projection 12 on the inner subsection 10 carries a stop 16 designed as a thickened portion, which interacts with a complementary stop within the projection 13 on the outer subsection 9. In this way, the upward movement of the inner subsection 10 relative to the outer subsection 9 is limited. For its part, the sleeve-shaped projection 13 on the outer subsection 9 of the float 4 is guided in a guide 17, which is supported by radially inward-projecting webs 18 of the tubular body 2 (see FIG. 6). At its lower end, the projection 13 on the outer subsection 9 likewise carries a stop 19 designed as a thickened portion, which limits the upward movement of the outer subsection 9 relative to the tubular body 2. The nonreturn valve 1 with the float 4 of two-stage design is thus suitable for high-power combustion devices while simultaneously coping with the part-load range. However, a person skilled in the art will recognize that the float 4 can also be embodied as a single part or with more than two parts.

In the nonreturn valve 1 according to FIG. 1, the tubular body 2 is of multi-part design and comprises a tubular element 20 and a support element 21, which are illustrated in greater detail in FIGS. 5 and 6. The support element 21 can be mounted removably on the tubular element 20 and can be introduced or inserted into the latter. For this purpose, the support element 21 has a plurality of latching projections 22, which are formed at uniform intervals on the outer circumference, as can be seen in FIG. 6. As can furthermore be seen in FIG. 5, the tubular element 20 has a plurality of latching recesses 23, which are formed in a manner complementary to the latching projections 22 and in which the latching projections 22 engage when the tubular element 20 and the support element 21 are fitted together to form the tubular body 2.

As can be seen from FIGS. 5, 9 and 10, for example, the tubular element 20 has a tube section of double-walled design which is formed by an outer tube section 24 and an inner tube section 25. The double-walled tube section of the tubular element 20 is closed by a wall section 26 connecting the outer tube section 24 and the inner tube section 25 and extending obliquely. In the assembled condition of the tubular element 20 and the support element 21, the double-walled tube section of the tubular element 20 is open in the upstream direction or downward, and the outer tube section 24 extends further upstream than the inner tube section 25. The mounting of a collar-shaped connecting element 39, which is shown in detail in FIG. 7, is envisaged at the upper end of the tubular element 20 for the purpose of connection to the exhaust line, and a seal element 40 that can be inserted into the collar-shaped connecting element 39 and which is illustrated in greater detail in FIG. 8, is provided for sealing.

The support element 21 likewise comprises a double-walled tube section having an outer tube section 27 and an inner tube section 28, wherein the tube section of double-walled design is closed at one longitudinal end by means of a wall section 29 connecting the outer tube section 27 and the inner tube section 28. In the assembled condition of the tubular element 20 and the support element 21, the double-walled tube section of the support element 21 is open upward or in the downstream direction, whereas the double-walled tube section of the tubular element 20 is open in the upstream direction or downward. In the case of the support element 21, the outer tube section 27 has a greater axial length than the inner tube section 28, with the result that the circumferential rim 30 of the outer tube section 27 is arranged below or upstream of the circumferential rim 31 of the inner tube section 28.

The circumferential rim 5 is thus part of the support element 21, wherein the radially outer circumferential wall section 7 is formed by an axial section of the inner tube section 27 of the support element 21, whereas the radially inner circumferential wall section 6 is formed by a wall section 32 which is formed integrally on the inner tube section 27 of the support element 21 and is oriented radially inward. The circumferential rim 33 of the wall section 32 formed integrally on the inner tube section 27 of the support element 21 lies above or upstream both of the circumferential rim 30 of the outer tube section 27 and of the circumferential rim 31 of the inner tube section 28 of the support element 21. On the support element 21, therefore, the circumferential rim 30 of the outer tube section 28 lies downstream of the circumferential rim 31 of the inner tube section 28 and upstream of the circumferential rim 33 of the wall section 32 or circumferential wall section 6. The radially inward-projecting webs 18 which support the sleeve-shaped guide 17 for the projection 13 on the outer subsection 9 of the float 4 are formed integrally on the wall section 32 or radially inner circumferential wall section 7.

In the assembled condition of the tubular body 2, the inner tube section 25 of the tubular element 20 and the double-walled support element 21 form a U-shaped siphon 34, which is illustrated in the form of the dashed line in FIG. 11. The U-shaped siphon is formed by arranging the inner tube section 25 of the tubular element 20 substantially coaxially between the outer tube section 27 and the inner tube section 28 of the support element 21, and there is a gap between the circumferential rim or free end of the inner tube section 25 of the tubular element and the wall section 29 of the support element 21. During the operation of the nonreturn valve 1, the U-shaped siphon 34 should be filled with a fluid at all times, making it more difficult or impossible for exhaust gases to pass through the channel or conduit system of the U-shaped siphon 34. At the same time, however, condensate stemming from the exhaust gas can flow off via the U-shaped siphon 34, thus ensuring satisfactory functioning of the nonreturn valve 1. The precise mode of operation of the U-shaped siphon 34 will be explained in detail below. It should be noted that the two-part tubular body 2 can, of course, also be of one-part or one-piece design but the aim should be an at least two-part embodiment for the manufacture of the complex siphon-type wall system to make production easier.

With reference to the figures, the circumferential rim of the outer subsection 9 of the float 4, said outer subsection being of annular design, has an axial lip 35 which projects radially over the radially inner circumferential wall section 6 or wall section 32. As can be seen, in particular, in FIG. 1, the axial lip 35, which faces upstream or vertically downward, extends in the axial direction into the circumferential groove 5 when the outer subsection 9 of the float 4 is resting on the valve seat 3. Moreover, the outer subsection 9 of the float 4 comprises a radial lip 36, which faces radially outward and starts from the axial lip 35. The radial lip 36 extends as far as the circumferential rim 31 of the inner tube 28 of the support element 21. As can be seen, in particular, in FIGS. 1 and 9 to 16, the radial lip 36 of the outer subsection 9 of the float 4 extends at least into the region of a bevel 37 formed on the circumferential rim 33 of the radially inner circumferential wall 6. The bevel 37 extends radially outward and upstream, with the result that condensate precipitated vertically downward or upstream from the exhaust gas is not drained into the circumferential groove 5 but into the U-shaped siphon 34 radially adjoining the latter in the outward direction or flows off in that direction.

FIGS. 11 to 16 show detail views of part of the nonreturn valve 1, in which the combustion device is not in operation and the float 4 is in each case in the closed position and the outer subsection 9 is resting on the valve seat 3.

The illustration in FIG. 11 corresponds to an operating state following the installation of the nonreturn valve 1 in an exhaust line of a combustion device. In this case, the circumferential groove 5 and the U-shaped siphon 34 formed by the tubular element 20 and the support element 21 are free from any fluid and condensate. In the illustrated closed position of the float 4, the inner subsection 10 of the float 4 forms a mechanical seal by contact with the additional valve seat 11 of the outer subsection 9 of the float 4. In addition, the outer subsection 9 of the float 4 forms a mechanical seal with the valve seat 3 by means of its contact surfaces. Owing to the absence of fluid in the U-shaped siphon 34, said siphon is subject to leakage, thus allowing exhaust gases to flow to regions situated vertically below the float 4.

In order to prevent the leakage in the region of the U-shaped siphon 34, the U-shaped siphon 34 formed by the tubular element 20 and the support element 21 is filled with a predetermined quantity of fluid 38 before the combustion device or nonreturn valve 1 is put into operation. This operating state is illustrated in FIG. 12, wherein the quantity of fluid 38 must be at least such that it is no longer possible for exhaust gas to pass through the U-shaped siphon 34, i.e. the quantity of fluid 38 must reach at least as far as the free longitudinal end of the inner tube section of the tubular element 20. A fluid barrier is then obtained in the U-shaped siphon 34 by introducing fluid 38, said barrier preventing exhaust gas from passing through to regions of the nonreturn valve 1 situated below the float 4, while the outer subsection 9 and the inner subsection 10 of the float 4 provide a mechanical seal, as before, and prevent exhaust gases from getting upstream.

The level to which the fluid 38 rises in the U-shaped siphon 34 is limited by the design configuration of the support element 21. The level to which the fluid 38 rises within the U-shaped siphon 34 is restricted by the circumferential rim 30 of the outer tube section 27 and the circumferential rim 31 of the inner tube section 28. Owing to condensate stemming from the exhaust gas which has flowed through the nonreturn valve 1, the level of fluid 38 in the U-shaped siphon 34 can rise beyond that shown in FIG. 12. If the level of the fluid 38 rises above the circumferential rim 31 of the inner tube section 28 of the support element 21, the mixture of fluid and condensate flows over the circumferential rim 31 into the circumferential groove 5, leading to the filling of the circumferential groove 5 if it was previously free of fluid, as can be seen from FIG. 13. The U-shaped siphon 34 can thus provide for a supply of water to the circumferential groove 5. In the closed position of the float 4, the axial lip 35 of the outer subsection 9 dips into the mixture of fluid and condensate that is now also present in the circumferential groove 5. In this way, the mechanical sealing due to the fact that the outer subsection 9 is resting on the valve seat 3 is supplemented by a fluid seal brought about by the interaction of the fluid and the axial lip 35. When the outer subsection 9 of the float 4 is resting on the valve seat 3, the fluid 38 in the circumferential groove 5 thus forms a gas tight fluid barrier together with the axial lip 35. Moreover, no heavy sediments from the exhaust gas get into the circumferential groove 5 because the outer subsection 9 of the float 4 has the radial lip 36, which covers the circumferential groove 5. Instead, heavy sediments are directed into the U-shaped siphon 34, where they can settle on the wall section 29. The radial lip 36 of the float 4 thus forms a guard against sediments stemming from the stream of exhaust gas, which can only be deposited and accumulate in the section of the U-shaped siphon 34. The level to which the mixture of fluid 38 and condensate rises, as illustrated in FIG. 13, represents the maximum level to which it rises in the circumferential groove 5 and the U-shaped siphon 34.

If the level of the mixture of fluid 38 and condensate rises further, the system drains via the U-shaped siphon 34, as illustrated in FIG. 14. In doing so, the mixture flows over the circumferential rim 30 of the outer tube section 27 of the support element 21. It is expedient if the circumferential rim 30 of the outer tube section 27 is arranged below the radial rim 36 in the upstream direction but above the circumferential rim 31 of the inner tube section 28 of the support element 21 in the downstream direction, thus preventing the mixture of fluid 38 and condensate from rising above the radial rim 36, thereby possibly preventing the outer subsection 9 of the float 4 from rising. A further rise in the fluid level therefore merely leads to the mixture of fluid 38 and condensate flowing off via a drainage channel 41 formed between the outer tube 27 of the support element 21 and the outer tube 24 of the tubular element 20.

FIG. 15 shows an operating state which can follow the operating state illustrated in FIG. 14. In the operating state shown in FIG. 15, the float 4 is once again in the closed position, and there is an excess pressure prevailing downstream of the nonreturn valve 1, said pressure acting on the float 4 and pressing the outer subsection 9 onto the valve seat 3. This excess pressure furthermore has the effect that the fluid 38 in the circumferential groove 5 and in the U-shaped siphon 34 is pressed downward in the upstream direction. However, the fluid 38 in the circumferential groove 5 can only reach as far as the mechanical sealing seat formed by the float 4 and the valve seat 3, and no further. Moreover, the fluid 38 in the channel formed between the inner tube section 28 of the support element 21 and the inner tube section 25 of the tubular element 20 is pressed downward in the upstream direction, thus enabling the fluid 38 to flow off via the drainage channel 41 formed between the outer tube section 27 of the support element 21 and the outer tube section 24 of the tubular element 20. In this operating state of excess pressure, in which there is a low excess pressure prevailing, the quantity of fluid 38 in the circumferential groove 5, said quantity being illustrated in FIG. 15, is sufficient to bring about the fluid sealing effect between the outer subsection 9 of the float 4 and the fluid 38 since a lower section of the axial rim 35 is dipped into the fluid 38, as before.

FIG. 16 shows an operating state similar to a fault, in which the circumferential groove 5 does not have any fluid and has dried out. As before, however, a mechanical seal is accomplished by means of the contact between the outer subsection 9 of the float 4 and the valve seat 3. Owing to the low fluid level or absence of barrier water in the circumferential groove 5, absolute gas tightness is ensured only up to a certain excess pressure. If this excess pressure is exceeded, the system continues to provide a mechanical seal by way of the contact surfaces. This fault, in which the combustion device is at a standstill and condensate or fluid in the circumferential groove 5 has evaporated, is comparable to the operating state illustrated in FIG. 12, and therefore reference may be made to the explanations given in relation to said operating state.

A development of the nonreturn valve 1 described above is illustrated in FIGS. 17 and 18. In this development, a through opening 42, adjoining which on the outside of the wall of the tubular body 2 is a tubular stub 43, is formed in the wall of the tubular body 2. In this arrangement, the stub 43 can be designed in the manner of a connector for a water hose, for example. However, it is also conceivable to provide only the through opening 42 instead of the stub 43, it being possible to introduce a water hose into the interior of the tubular body 2 through said opening for purposes of maintenance and cleaning. It is thereby possible to direct water for cleaning above the float 4 or directly into the U-shaped siphon 34. During cleaning, dirt particles are flushed out through the U-shaped siphon 34 and then via the drainage channel 41 owing to the large volume of water. During operation, the through opening 42 or the stub 43 is closed by means of a cap (not shown).

To form the internally arranged siphon 34 of U-shaped design by means of the tubular element 20 and the support element 21, the tubular body 2 described in FIGS. 1 to 17 is of two-part configuration. In contrast, a one-part design of the tubular body 2 is provided for the nonreturn valve 1 illustrated in FIGS. 19 to 21, said design providing no siphon formed within the tubular body 2. In order to remove excess fluid from the interior of the tubular body 2, a through opening 44 is provided in the wall of the tubular body 2, said opening starting substantially at the level of the circumferential rim 30 of the radially outer circumferential wall section 7 and extending downstream. Connected to the through opening 44 is a pipe section 45, which leads to a siphon device 46 arranged outside the tubular body 2. This externally arranged siphon device or external siphon 46 is of two-part design and comprises a first component 47 and a second component 48. Both components 47 and 48 are designed in the manner of a two-part container and can be connected to one another centrally. In this case, the pipe section 45 is connected to the first component 47. Moreover, this pipe section 45 extends within the two assembled components 47, 48 to a point just before the bottom wall of the second component 48, which is of pot-shaped design. At the side of the first component 47, a further pipe section 49 leads back from the siphon 46 to the nonreturn valve 1. This pipe section 49 opens into a passage opening 50, which is formed in the wall of the tubular body 2 upstream of, i.e. below, the float 4. Excess fluid or even dirt particles can be removed from the interior of the tubular body 2 and directed into the siphon 46 through the through opening 44. For this purpose, the tube section 45 is configured so as to slope downward with a slight obliquity in the direction of the siphon 46. The fluid and dirt particles directed into the siphon 46 collect in the second component 48, which is of pot-shaped design. As soon as the level of fluid accumulated within the siphon 46 reaches the level of the passage opening 50, the fluid flows back into the interior of the nonreturn valve 1 via the pipe section 49, this being indicated by the arrows. In the interior of the nonreturn valve 1, the fluid returned can then be directed to a condensate drainage system, for example, and discharged from there. The principle of the siphon 46 arranged outside the tubular body 2 is identical with the mode of action described in FIGS. 11 to 16. As long as the free end of the tube section 45 extending into the vicinity of the bottom wall of the pot-shaped component 47 is immersed in fluid, which can be accomplished before the nonreturn valve 1 is put into operation, for example, by appropriate filling, no exhaust gas present downstream of the float 4 can get into the region below the float 4 since the siphon 46 prevents gas passing through owing to the filling thereof.

The invention has been implemented on the basis that the production of large floats in an injection molding process causes major difficulties in maintaining specific tolerances on the individual components. In the case of injection molded components of large dimensions, said components always exhibit a certain distortion after the cooling process. The effect of this distortion is that the mechanical seal between the valve seat and the float may be inadequate since continuous contact between the components, as required for the seal, is not assured owing to the distortion. Since components for such an area of application are additionally exposed to massive temperature loads by the flowing exhaust gas, these loads can additionally cause a distortion of the material, which can increase the leakage. The invention exploits the characteristic of fluids since they always adapt to the contours of the components. For this reason, a fluid seal or fluid sealing seat is provided in addition to the known mechanical seal between the float and the valve seat. With the aid of the invention, therefore, even a relatively severely distorted float 4 can provide a virtually perfect seal as long as the axial lip 35 thereof dips into a fluid 38 in the circumferential groove 5 and the level of fluid is sufficiently high. In order to prevent deposits of dirt particles within the circumferential groove 5, which could have a negative effect on the fluid seal, the float additionally has the radial lip 36 projecting radially outward over the circumferential groove 5. In the case of the siphon 34 of U-shaped design provided within the tubular body 2, dirt particles are thus directed directly into said siphon and can be flushed out during maintenance work, for example, by introducing water into the tubular body 2 through the through opening 44 for the purpose of flushing. In the case of an external siphon 46 or siphon mounted on the outside of the tubular body 2, said siphon is easily removed from the tubular body 2 and cleaned for maintenance and cleaning purposes. In addition to the fluid barrier formed in the circumferential groove 5 by a fluid and the axial lip 35, the invention thus comprises a siphon 34 or 46 which is arranged and formed radially on the outside around the circumferential groove 5 and within the tubular body or outside the tubular body 2.

The inner subsection 10 of the float 4 is purely optional, with this subsection 10 providing only a mechanical seal in the embodiment illustrated. In a modification of the embodiment illustrated, the circumferential rim of each inner or next-smaller subsection 10 can have an additional axial lip, which projects radially outward over the additional valve seat 11, which is oriented in the upstream direction and which extends into an additional circumferential groove formed on the next-larger subsection 9 when the next-smaller subsection 10 is resting on the additional valve seat 11 of the outer or next-larger subsection 9. However, the inner subsection 10 exhibits only small amounts of leakage at the mechanical sealing seat, owing to its smaller dimensions, and component distortion also tends to be small, owing to the relatively small dimensions, making it possible to dispense with a fluid sealing seat for this region. In principle, however, the use of a fluid seal of the kind provided between the outer subsection 9 and the circumferential groove 5 by means of the fluid 38 and the axial lip 36 is also conceivable for inner subsections. However, it is also conceivable for the invention presented to be used in applications involving a one-part float.

Of course, the invention described above is not restricted to the embodiment described and illustrated. An outer subsection of the float without a radial lip is conceivable, for example, since it does not make any direct contribution to the fluid seal. Numerous modifications that are obvious to a person skilled in the art, given the intended use, can be made to the embodiment illustrated in the drawing without exceeding the scope of the invention. At the same time, the invention includes everything contained in the description and/or illustrated in the drawing, including whatever is obvious to a person skilled in the art, even though it deviates from the specific embodiment.

The invention claimed is:

1. Nonreturn valve for an exhaust line of a combustion device, wherein the nonreturn valve comprises a tubular body, which can be installed in a vertical section of the exhaust line and which is formed by a tubular element and a support element that is inserted into the tubular element and can be mounted removably on the tubular element, a valve seat, formed within the tubular body, for at least one float, which can be raised from the valve seat by gas flowing vertically upward, and at least one circumferential groove, which is open in the downstream direction, is arranged radially on the inside in the tubular body and is delimited by a radially inner circumferential wall section and a radially outer circumferential wall section, wherein the radially inner circumferential wall section and the radially outer circumferential wall section are formed within the tubular body, and a circumferential rim of the radially inner circumferential wall section forms the valve seat for the at least one float, wherein a circumferential rim of the at least one float projects radially over the radially inner circumferential wall section and has an axial lip facing upstream, which extends in the axial direction into the circumferential groove when the at least one float is resting on the valve seat.

2. Nonreturn valve according to claim 1, wherein a fluid situated in the circumferential groove enables the axial lip together with the fluid to form a gas tight fluid barrier when the float is resting on the valve seat.

3. Nonreturn valve according to claim 1, wherein at least a section or sections of a circumferential rim of the radially outer circumferential wall section has/have a bevel extending radially outward and upstream.

4. Nonreturn valve according to claim 3, wherein the float has a radial lip, which faces radially outward and extends at least into the region of the bevel on the circumferential rim of the radially outer circumferential wall section.

5. Nonreturn valve according to claim 1, wherein the tubular body has at least one through opening, which is arranged and formed downstream of a circumferential rim of the radially outer circumferential wall section.

6. Nonreturn valve according to claim 1, wherein the tubular element and the support element are each designed as a double-walled tube section, wherein each tube section has an outer tube section and an inner tube section arranged coaxially with the outer tube section, and wherein each of the tube sections is furthermore closed at the end by a wall section connecting the outer tube section and the inner tube section.

7. Nonreturn valve according to claim 6, wherein at least the outer tube section of the support element has a greater axial length than the inner tube section of the support element.

8. Nonreturn valve according to claim 6, wherein the radially outer circumferential wall section is formed by an axial section of the inner tube section of the support element, and the radially inner circumferential wall section is formed by a wall section which is formed integrally on the inner tube section of the support element and is oriented radially inward.

9. Nonreturn valve according to claim 6, wherein the support element of double-walled design is open in the downstream direction and the tubular element of double-walled design is open in the upstream direction in the assembled condition of the nonreturn valve, wherein the inner tube section of the tubular element and the double-walled support element form a U-shaped siphon since the inner tube section of the tubular element is arranged, preferably coaxially, between the outer tube section and the inner tube section of the support element.

10. Nonreturn valve according to claim 6, wherein, in the case of the support element, a circumferential rim of the inner tube section ends upstream of a circumferential rim of the outer tube section.

11. Nonreturn valve according to claim 6, wherein a drainage channel for excess fluid is formed between the outer tube section of the support element and the outer tube section of the tubular element.

12. Nonreturn valve according to claim 1, wherein the float has a subsection of annular design and at least one subsection of disk-shaped design, wherein each next-larger subsection forms an additional valve seat for the next-smaller subsection.

13. Nonreturn valve according to claim 12, wherein a circumferential rim of at least a next-smaller subsection comprises an additional axial lip, which projects radially outward over the additional valve seat, which is oriented in the upstream direction and which extends into an additional circumferential groove formed on the next-larger subsection when the next-smaller subsection is resting on the additional valve seat of the next-larger subsection.

* * * * *